United States Patent [19]

Alley et al.

[11] Patent Number: 4,734,650

[45] Date of Patent: Mar. 29, 1988

[54] ADJUSTING FEEDBACK GAIN IN A FLUORESCENT LAMP DIMMING CONTROL

[75] Inventors: Robert P. Alley, Clifton Park; William H. Bicknell, Ballston Lake; Kevin C. Routh, Schenectady, all of N.Y.

[73] Assignee: General Electric Company, Schenectady, N.Y.

[21] Appl. No.: 780,143

[22] Filed: Sep. 26, 1985

[51] Int. Cl.[4] ..... G05F 1/10

[52] U.S. Cl. ..... 324/414; 315/DIG. 4; 328/178

[58] Field of Search ..... 324/414; 315/DIG. 4; 307/264; 328/175

[56] References Cited

U.S. PATENT DOCUMENTS

| | | | |
|---|---|---|---|
| 3,991,344 | 11/1976 | Tabor | 315/DIG. 4 X |
| 4,008,416 | 2/1977 | Nakasone | 315/DIG. 4 X |
| 4,060,751 | 11/1977 | Anderson | 315/DIG. 5 X |
| 4,060,752 | 11/1977 | Walker | 315/DIG. 5 X |
| 4,251,752 | 2/1981 | Stolz | 315/DIG. 7 X |
| 4,350,935 | 9/1982 | Spira et al. | 315/294 X |
| 4,353,009 | 10/1982 | Knoll | 315/DIG. 4 X |
| 4,414,493 | 11/1983 | Henrich | 315/DIG. 4 X |
| 4,503,364 | 3/1985 | Engle | 315/DIG. 4 X |
| 4,686,428 | 8/1987 | Kuhnel et al. | 315/309 X |

*Primary Examiner*—Reinhard J. Eisenzopf
*Assistant Examiner*—Robert W. Mueller
*Attorney, Agent, or Firm*—Marvin Snyder; James C. Davis, Jr.

[57] ABSTRACT

By monitoring line current before the lamps of a fluorescent lighting system start, an estimate of full load current is made. The estimate is used to adjust the current feedback gain to avoid any current level overflow in the control. The normalized values used within the control result in consistent relative light levels independent of load size.

15 Claims, 9 Drawing Figures

Fig. 8A

```
LOCATION   OBJECT   LINE   SOURCE
                          MAIN PROGRAM
                          :
00ED       753DFF   291      MOV START_ CNTR, # OFFH
00F0       753EFF   292      MOV START_ CNTR, +1, # OFFH     ; INITIALIZE DELAY COUNT
                    294    DELAY_ LOOP:
00F3       D53DFD   295      DJNZ START_CNTR, DELAY_ LOOP
00F6       D53EFA   296      DJNZ START_ CNTR + 1, DELAY_LOOP ; LOOP FOR 256 x 512 µSEC
00F9       D210     297      SET B B_ START_ ENABLE          ; ENABLE GAIN ADJUSTMENT
                    301    LOOP:
00FB       3013FD   302      JNB B_SHUT_ ENABLE, LOOP        ; IDLE LOOP UNTIL SHUTDOWN
                          START-UP CURRENT GAIN ADJUSTMENT ROUTINE
                          :
0172       E53B     409      MOV A, V_SF_ PTR                ; LATEST GAIN TABLE INDEX
0174       B41302   410      CJNE A, # 13H, GAIN_ CALC       ; JUMP IF NOT TABLE END
0177       8010     411      SJMP ENABLE _ CONTROL           ; AT END OF TABLE
                    413    GAIN_ CALC:
0179       C3       414      CLR C
017A       E528     415      MOV A, V_I_ COUNT
017C       8529F0   416      MOV B, V_I_ COUNT +1            ; GET CURRENT FROM TIMING MEANS
017F       9548     417      SUBB A, A_I_ REF                ; SUBTRACT REFERENCE
0181       C5F0     418      XCH A, B
0183       9549     419      SUBB A, A_I_ REF+1
0185       C5F0     420      XCH A, B
0187       500D     421      JNC REDUCE_SF                   ; IF RESULT POSITIVE, REDUCE GAIN
                    423    ENABLE_CONTROL:
0189       D211     424      SET B B_FB_ ENABLE              ; ENABLE CONTROL LOOP
018B       C210     425      CLR B_ START_ ENABLE            ; DISABLE GAIN ADJUSTMENT
018D       752A59   426      MOV V_ NOTCH_ COMMAND # 059H
0190       752B06   427      MOV V_ NOTCH_ COMMAND # 06H     ; SET UP NOTCH PERIOD
                          (CONTINUED WITH FIGURE 8B)
```

(CONTINUING FROM FIGURE 8A)

Fig. 8B

```
LOCATION  OBJECT   LINE   SOURCE
  0193    0201AA   428      JMP END_SF                    ;EXIT
                   430    REDUCE_SF:
  0196    89F0     431      MOV B, R1                     ;SAVE R1 CONTENTS
  0198    79B0     432      MOV R1, #I_DAC                ;GET ADDRESS OF D/A
  019A    E53B     433      MOV A, V_SF_PTR               ;GET INDEX
  019C    04       434      INC A                         ;POINT TO NEXT GAIN VALUE
                   436    SAVE_PTR:
  019D    F53B     437      MOV V_SF_PTR, A               ;SAVE NEW POINTER VALUE
  019F    9001AB   438      MOV DPTR, #GAIN_TBL           ;GET TABLE BASE ADDRESS
  01A2    93       439      MOVC A, @A+DPTR               ;GET NEW GAIN VALUE
  01A3    F544     440      MOV A_DAC_GAIN, A             ;SAVE GAIN VALUE
  01A5    E544              MOV A, A_DAC_GAIN
  01A7    F3                MOVX @R1, A                   ;SEND GAIN VALUE TO D/A
  01A8    A9F0     447      MOV R1, B                     ;RESTORE R1
                   449    END_SF:
  01AA    22       450      RET                           ;EXIT
                   452    GAIN_TBL:
                   453      DB 0FFH, 80H, 55H, 40H, 33H, 2BH, 25H, 20H, 1CH, 19H
                   454      DB 17H, 15H, 14H, 12H, 11H, 10H, 0FH, 0EH, 0DH, 0CH
```

ADJUSTING FEEDBACK GAIN IN A FLUORESCENT LAMP DIMMING CONTROL

The present application is related to U.S. application Ser. No. 780,548, entitled "Energy Management/Dimming System and Control", Alley et al., and to U.S. application Ser. No. 780,142, entitled "Wall Box Fluorescent Lamp Dimmer", Alley et al., both filed of even date and assigned to the assignee of the present application, and both of which are incorporated by reference.

BACKGROUND OF THE INVENTION

The present invention relates in general to a fluorescent lamp dimming system and more specifically to method and apparatus for adjusting feedback gain in a dimming control which uses current as a feedback variable.

Much work has been done to achieve dimming of fluorescent lamps which are installed in connection with conventional, nondimming ballasts. Due to the large number of such ballasts in use, retrofit devices have appeared which connect in the power line to the ballast and condition the supplied power so as to controllably reduce the light output from the lamps.

Above-mentioned application Ser. No. 780,548 pertains to an electronic control and a control method for dimming fluorescent lamps. In that invention, the power supplied to the ballast is conditioned in a manner as was described in prior application Ser. No. 645,593 of Alley et al., filed Aug. 30, 1984 now U.S. Pat. No. 4,604,552 issued Aug. 5, 1986. In the prior application, it was disclosed that fluorescent lamps may be dimmed by lowering the duty cycle of the 60 hertz AC line voltage supplied to the ballast and that, at the same time, filament heating may be maintained by adding a high frequency voltage (at least ten times greater than the line frequency) to the ballast voltage.

The dimming control disclosed in application Ser. No. 780,548 uses ballast current as a measure of the light output of the lamps in obtaining closed loop feedback. Thus, by keeping ballast current at a nearly constant magnitude corresponding to a particular light level, a fairly consistent light output can be achieved even in the face of fluctuations in the power line voltage.

The ballast input current flowing at full lamp brightness varies depending on the specific lamps and ballast used. The dimming control preferably must be flexible enough to accommodate the variation of full load current from lighting system to lighting system. In addition to the variety of different lamps and ballasts which arise, the number of ballasts connected in a branch circuit varies. There is also the possibility that some lamps might not be functional and that some ballasts may simply be turned off. In order to use ballast current as a feedback variable, full load current for the particular lighting system must be approximated before it is actually flowing so that the feedback gain can be adjusted to normalize it with the other control parameters. Otherwise, current values could arise which overflow the control capabilities.

Accordingly, it is a principal object of the present invention to provide a method and apparatus for adjusting the feedback gain in a fluorescent lamp dimming control to a value which normalizes current feedback with the control constants.

It is another object of the invention to provide a method and apparatus for estimating the full load current of a fluorescent lighting branch circuit before full load current is actually flowing.

It is a further object of the invention to provide a fluorescent lamp dimming system which operates over a wide range of load sizes without any modification to the dimming control.

SUMMARY OF THE INVENTION

These and other objects of the invention are achieved by a method for estimating full load current for a fluorescent lighting system which comprises the steps of (1) turning on full power to the fluorescent lighting system; and (2) measuring the current flowing to the lighting system after initial transients decay and before the lamps of the lighting system begin conducting. An estimate of full load current can then be obtained by increasing the results of the measuring step by a factor of about two.

In another aspect of the invention, a method for adjusting the feedback gain of a fluorescent lamp dimming control comprises the steps of (1) turning on full power to the lighting system; (2) setting feedback gain to an initial value; (3) measuring current flowing to the lighting system after initial transients decay and before the lamps begin conducting, thus using the known feedback gain to obtain a measured current value; (4) comparing the measured current value with a control reference value; and (5) if the difference resulting from the comparison is greater than a predetermined value, then adjusting the feedback gain in a manner which causes the measured current value to approach the desired control reference value. This normalizes the control to the load.

The apparatus of the present invention provides adjustable current feedback in a microprocessor controlled fluorescent lamp dimming system. A current sensing means is adapted to be coupled to a fluorescent lighting system for providing a voltage proportional to the current flowing to the ballast of the lighting system. An adjustable scaling means is coupled to the current sensing means for scaling the voltage with an adjustable gain. The adjustable scaling means is adapted to be coupled to the microprocessor for receiving the amount of gain. A voltage-controlled oscillator means is coupled to the scaling means and provides a signal having a frequency proportional to the magnitude of the output signal of the scaling means. A counter means is coupled to the oscillator means for counting the pulses in the signal, the counted pulses representing the integral of the scaling means output signal. The counter means is also adapted to be coupled to the microprocessor for providing the results of the counting thereto.

BRIEF DESCRIPTION OF THE DRAWINGS

The novel features of the invention are set forth with particularity in the appended claims. The invention itself, however, as to organization and method of operation, together with further objects and advantages thereof, may best be understood by reference to the following description taken in conjunction with the accompanying drawings in which:

FIGS. 8A and 8B are a portion of the software used by the apparatus of FIG. 6 to implement the method of FIG. 7.

DETAILED DESCRIPTION OF THE INVENTION

Figure 1:
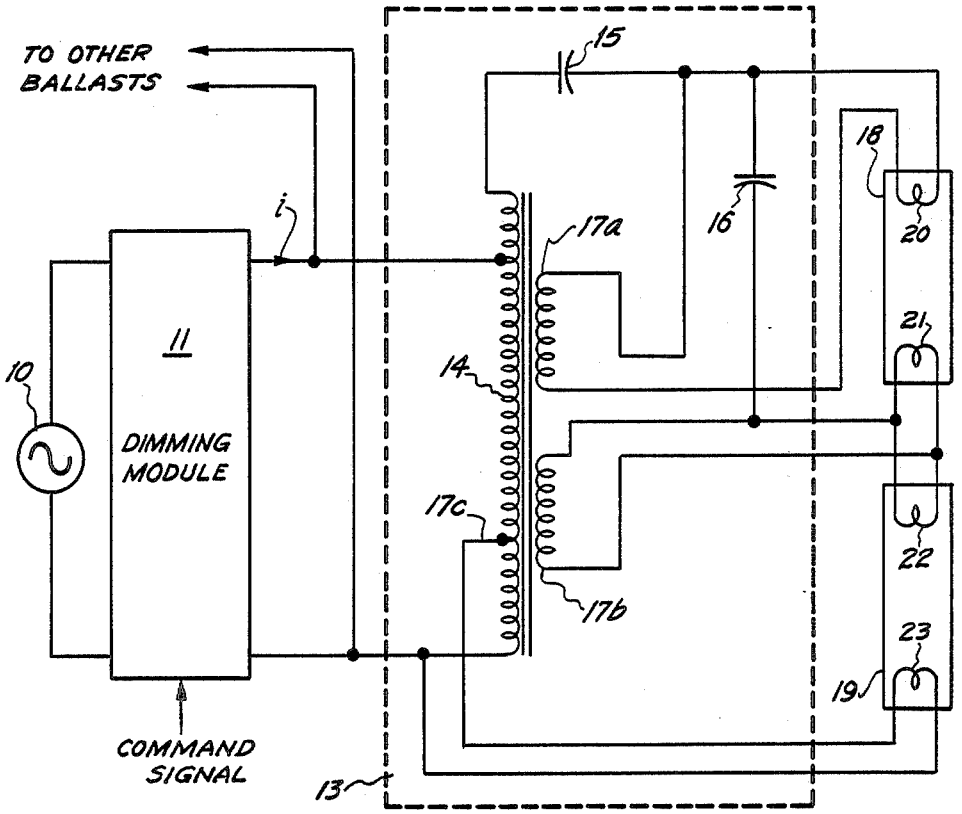
FIG. 1 is a part schematic, part block diagram of a fluorescent lighting system with a dimming module connected thereto.

Referring now to the drawings, FIG. 1 is a part block diagram, part schematic of a fluorescent dimming system for utilizing the present invention. A dimming module 11, for providing dimming in response to a command signal, is connected between an AC source 10, typically a 60 hertz power line from a distribution panel, and a conventional nondimming rapid-start fluorescent ballast 13 (an 8G1022W ballast manufactured by the General Electric Company is shown in the Figure). Ballast 13 powers series connected fluorescent lamps 18 and 19 and filament heaters 20–23 of lamps 18 and 19. Ballast 13 includes autotransformer 14, power factor correcting capacitor 15, starting capacitor 16 and filament secondaries 17*a*, 17*b* and 17*c*.

Figure 2:
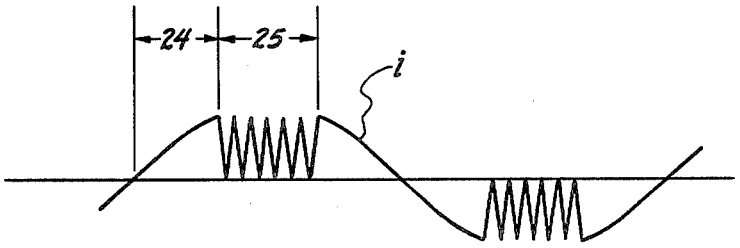
FIG. 2 is a waveform diagram of the current supplied by the dimming system during dimming.

In previously mentioned U.S. Pat. No. 4,604,552, it was disclosed that lamps 18 and 19 may be dimmed by lowering the duty cycle of the low frequency AC line voltage during each half-cycle of line voltage and adding a high frequency component to the ballast voltage either continuously or during the off portions of the low frequency component in order to maintain filament heating. In the present invention, dimming module 11 also performs this function except that a current reference is substituted for the voltage reference for compatibility with the wall box dimmer described in application Ser. No. 780,142 and for allowing current to be used as a feedback variable. Thus, the input current waveform is chopped by dimming module 11 as shown in FIG. 2. A notch delay period 24 is measured from a zero crossing of current i to the beginning of a notch period 25. Current is chopped during notch period 25 to produce a series of high frequency pulses which provide power to filaments 20–23 but which make essentially no contribution to the light output of lamps 18 and 19. By varying the length of notch delay 24 and the width of notch period 25, a variable light output from lamps 18 and 19 results. The frequency of the high frequency pulses is preferably at least 10 times greater than the frequency of source 10.

Figure 3:
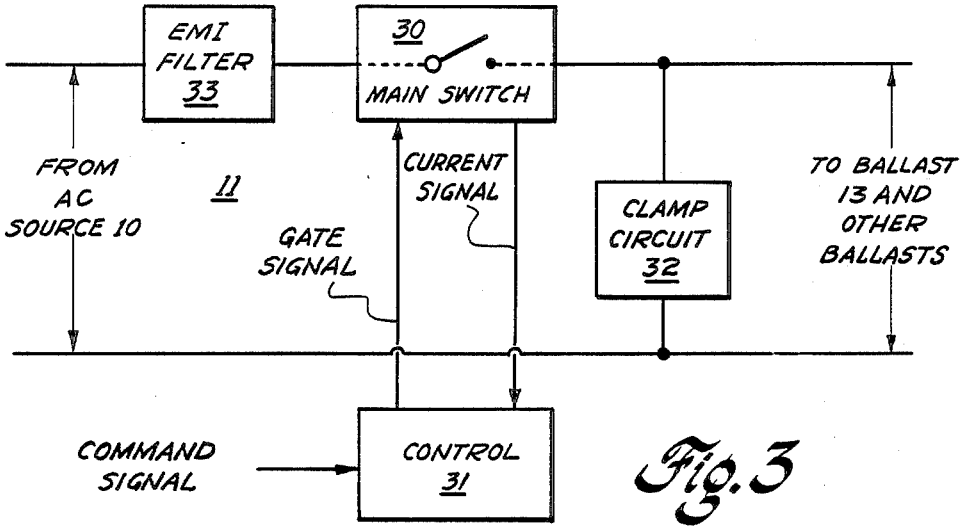
FIG. 3 is a block diagram showing the dimming module of FIG. 1 in greater detail.

One configuration of dimming module 11 for conditioning current i to obtain the waveform of FIG. 2 is shown in FIG. 3. A main switch 30 is connected in series with the ballast(s) and is adapted to be turned on when the lamps are on except during the notch periods when main switch 30 chops the ballast current at a high frequency. Control 31 controls the conduction of main switch 30 via a gate signal in response to a command signal, typically supplied from a remote location, and in response to a current signal fed back from main switch 30. A clamp circuit 32 is connected in parallel with the ballasts to limit the voltage across the ballasts which could otherwise rise to extremely high levels during rapid switching of the current supplied to the inductive ballast load by main switch 30. Examples of clamp circuit 32 are disclosed in U.S. patent application Ser. No. 677,413 of Alley et al., filed Dec. 3, 1984, entitled "Active Clamp Circuit" which is also of common assignment. An EMI filter 33 is connected between main switch 30 and AC source 10 to reduce electromagnetic interference propagating from dimming module 11.

It is apparent from FIG. 3 that control 31 generates the gate signal (i.e. notch delay 24 and notch period 25) to produce a light output from the lamps which corresponds to the command signal. The command signal typically will vary in accordance with a desired light level (e.g. a percentage of full brightness) as determined by an operator or a central computer. However, actual light level is measured indirectly by sensing the current flowing to the ballasts which is for practical purposes proportional to light output. But since full load current for a particular circuit is not known prior to actual operation, it would be advantageous for control 31 to determine full load current for the particular lighting system so that actual percentage of full brightness may be computed from the current signal. Furthermore, it would be advantageous to determine full load current without full load current actually flowing to avoid overflow of the control variables in control 31 and to allow the lamps to turn on at less than full brightness.

Figure 4:
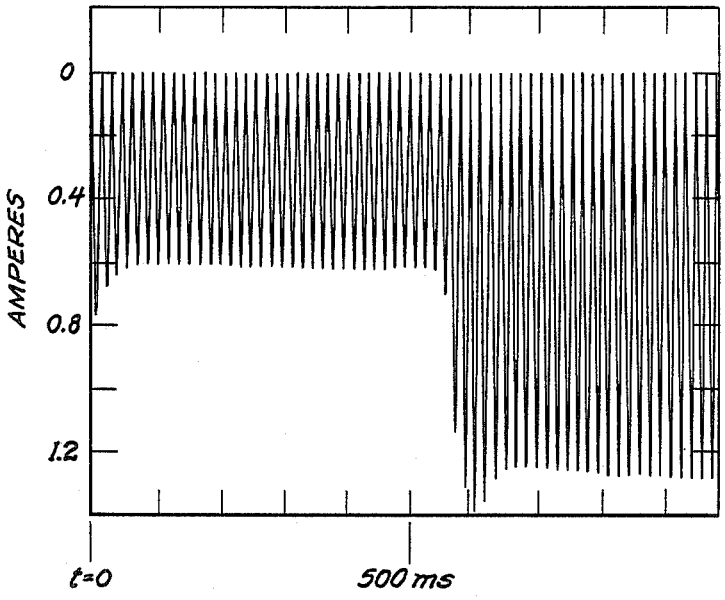
FIG. 4 is an oscilloscope tracing of current flowing to a fluorescent ballast during lamp starting.

The present invention takes advantage of a particular characteristic of conventional fluorescent lighting systems which will be described with reference to FIG. 4, which is an oscilloscope trace of full-wave rectified ballast input current with zero at the top and increasing current to the bottom of the trace. In taking the measurements of FIG. 4, two Watt Miser II® 40 watt fluorescent lamps manufactured by General Electric Company were connected to the ballast shown in FIG. 1. At t=0, full power of 120 volts, 60 cycles AC was turned on. By the end of the first 100 milliseconds the initial transient currents caused by turn on had decayed. Thereafter, peak current remained at a constant level until about 550 milliseconds after turn on, when the lamps started. Between about 200 and 500 milliseconds after turn on, peak current was about 0.6 amperes. After the lamps started, peak current (i.e. full load current) eventually stabilized at about 1.16 amperes, giving a ratio of about 1.9. There is some variation in the ratio of pre-starting current to full load current when the input voltage is changed. Voltage changes also affect the time at which the lamps start. Data for Watt Miser II® lamps and the 8G1022W ballast is summarized in the following table.

| Input Volts | Time to Lamp Start | Initial Current | Final Current | Ratio |
|---|---|---|---|---|
| 110 | 1100 mS | 0.48 A | 1.2 A | 2.5 |
| 120 | 550 | .6 | 1.16 | 1.9 |
| 130 | 450 | .78 | 1.15 | 1.5 |

Starting times and the ratio of initial current to final current for other fluorescent lamp and ballast combinations are similar to those given in the above table. For example, Mainlighter TM lamps (a product of General Electric Company) connected to the 446-L-VLH-TC-P ballast from the Universal Manufacturing Corporation gave a ratio of initial current to final current of 2.14 when starting with 120 VAC supplied. In general, an approximate value for full load current can be obtained by doubling the initial current value. The initial current is preferably measured at any time or times between 100 and 400 milliseconds after power is turned on.

The approximate nature of the estimate of full load current still results in acceptable performance of the dimming system because of the inability of individuals to perceive small variations in light level. Furthermore, it is noted that the lumen output of fluorescent lamps is never perfectly constant due to temperature changes during lamp operation.

Figure 5:
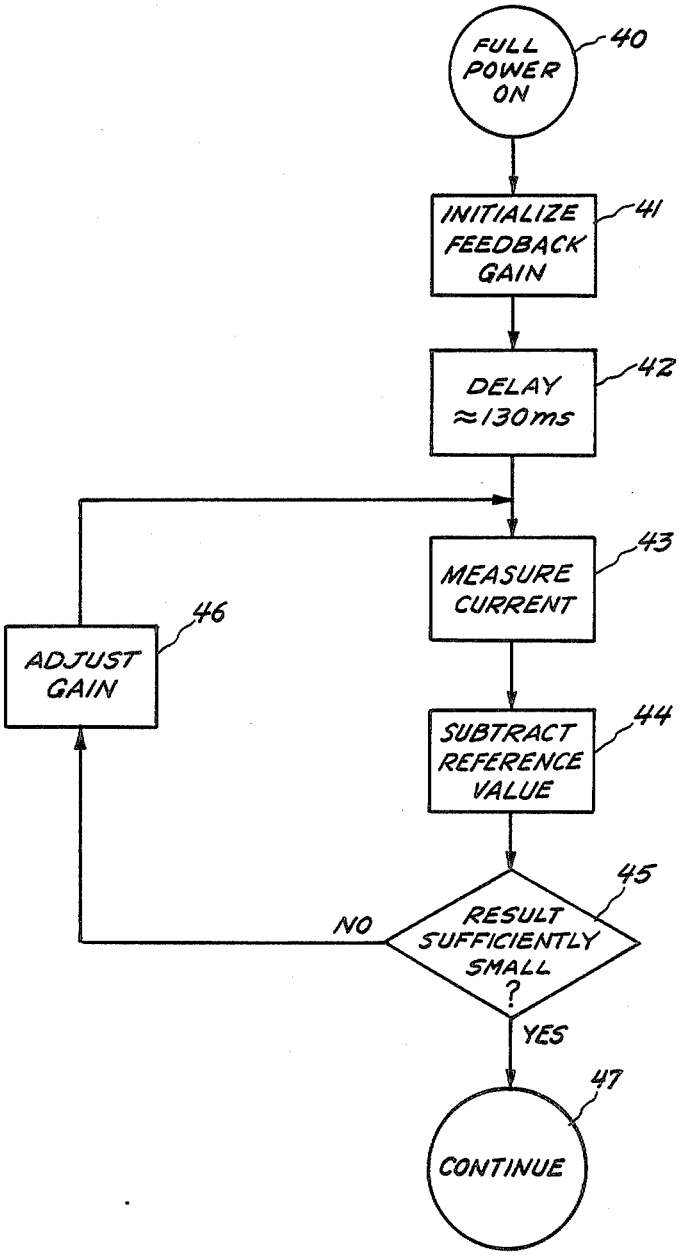
FIG. 5 is a flow chart of the method of the present invention.

Turning now to FIG. 5, a method for adjusting the feedback gain employed by the dimming control is shown. Full power to the ballast is turned on at step 40. Feedback gain is initialized to a known value in step 41. Step 42 comprises a delay period during which initial transients decay. The delay is at least 100 milliseconds, a 130 mS delay being shown in order to allow for a safety margin. Next, current is measured in step 43 in a manner which depends on the latest feedback gain value. In step 44, a reference value, which is proportional to the constant which is representative of full load current (i.e. full brightness) as used by the control, is subtracted from the measured current. In a preferred embodiment, the reference value used for the subtraction is one-half of the constant which represents full load current, thus eliminating any need to double the result of the subtraction. In step 45, the error is tested. If it is sufficiently small then the gain value is correct and the control proceeds to other operations at step 47. If the error is too large, then step 46 is executed. In step 46, the gain value is adjusted to correct the error, e.g. if the difference is positive then the gain value is reduced and vice versa. Next, the algorithm returns to step 43.

Figure 6:
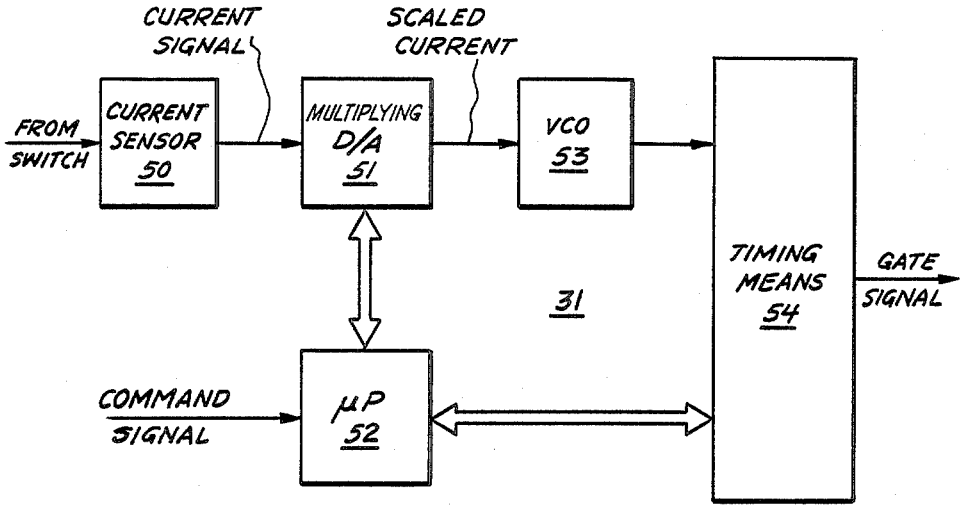
FIG. 6 is a block diagram of apparatus for practicing the present invention.

Apparatus for a fluorescent lamp dimming control having adjustable feedback gain is shown in FIG. 6. A current sensor 50 senses the absolute value of current flowing through the main switch to the ballasts. The current signal from current sensor 50 is coupled to a multiplying digital-to-analog converter 51. D/A converter 51 is connected to a microprocessor 52 and to a voltage-controlled oscillator (VCO) 53. A timing means 54 is connected to VCO 53 and to microprocessor 52. Timing means 54 generates the gate signal.

Multiplying D/A converter 51 converts the current signal to a scaled value. The analog current signal is multiplied by a digital scale factor which has been loaded into D/A converter 51 by microprocessor 52. The result of the multiplication is an analog voltage which is a scaled current signal. Multiplying D/A converter 51 may comprise, for example, the AD7524 manufactured by Analog Devices of Norwood, MA.

VCO 53 generates an AC signal having a frequency proportional to the scaled current signal. A digital counter in timing means 54 counts the cycles in the output signal from VCO 53. The amount of counted cycles is proportional to the integral of the scaled current signal. This integral may then be compared with the reference value by microprocessor 52, which also then modifies the scale factor (i.e. feedback gain) of D/A converter 51. VCO 53 may comprise the VFC 320 oscillator available from Burr Brown of Tucson, AZ. Timing means 54 may comprise the AM9513 system timing controller available from Advanced Micro Devices. An example of a microprocessor suitable for demonstrating the present invention is the 8751 microprocessor from Intel Corporation.

Other digital counters in timing means 54 are used to generate the notch delay, notch width and high frequency pulses which make up the gate signal. Microprocessor 52 controls these digital counters to achieve a light output from the lamps corresponding to the command signal. A more detailed description of these aspects of the dimming control may be found in copending application Ser. No. 780,548.

Figure 7:
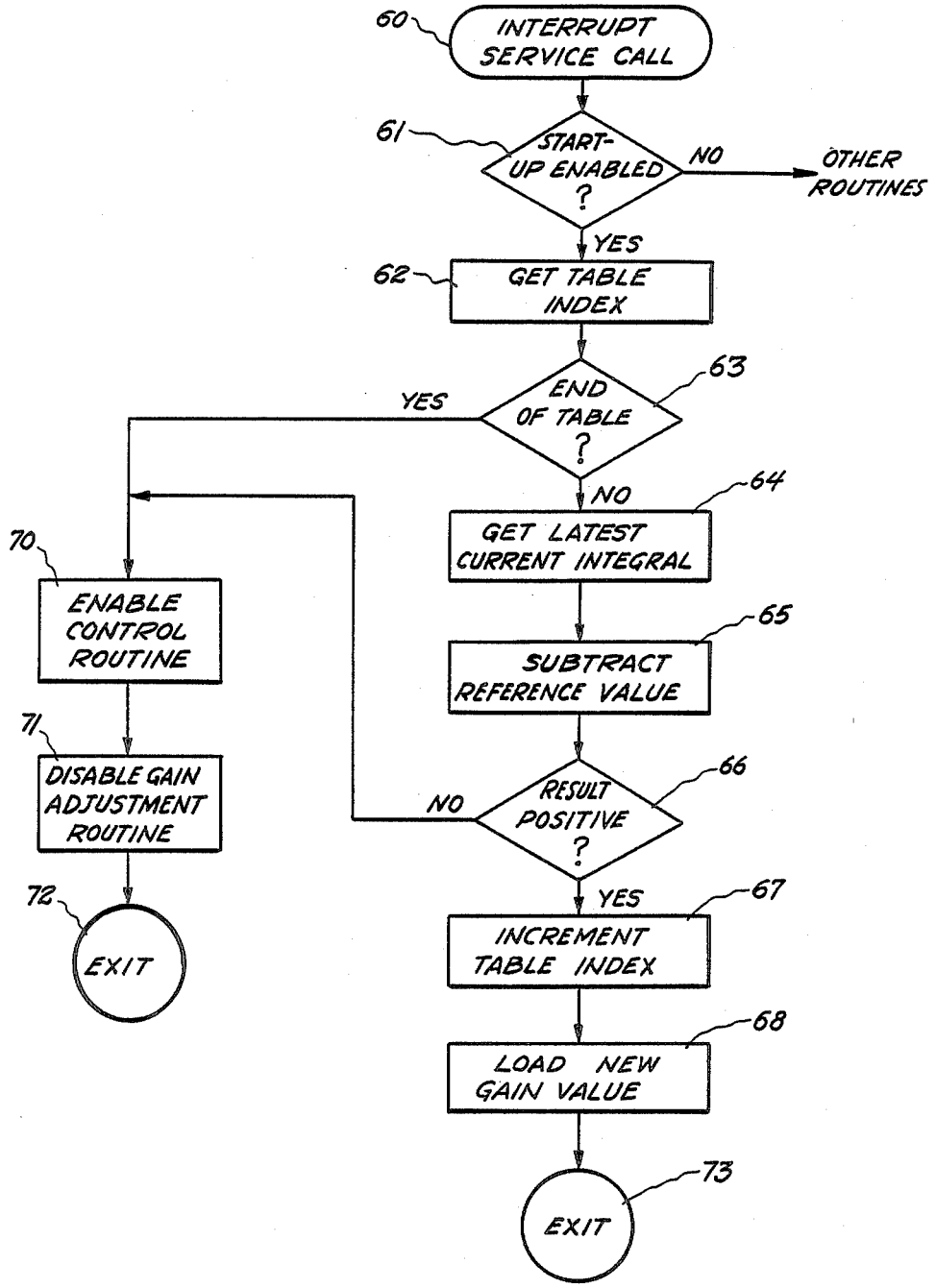
FIG. 7 is a flow chart of a method for practicing the present invention with the apparatus of FIG. 6.

FIG. 7 provides a flowchart of the method used by the microprocessor to adjust feedback gain. As described in application Ser. No. 780,548, current integrals are evaluated over each half-cycle of current and each zero-crossing of current generates an interrupt within the microprocessor. Upon entering an interrupt service call at step 60, the microprocessor checks whether the start-up gain adjustment routine has been enabled. The start-up routine will not be enabled until the 130 millisecond delay for transient decay has expired. If start-up is not enabled then other routines might be executed.

If start-up is enabled then an index pointer to a gain value table is fetched in step 62. Step 63 tests whether the end of the table (either smallest or largest possible gain value) has been reached. If so, then the main control routine is enabled in step 70, the gain adjustment routine is disabled in step 71, and the routine is exited in step 72. If there are more gain values left in the table, then the latest current integral measurement is fetched in step 64. The reference value is subtracted from the current integral in step 65.

In step 66, the result of the subtraction is tested. If it is not positive (in the case that the first gain value in the table is the largest and with successively decreasing gains), then a branch is made to step 70. If the result is positive then the table index pointer is incremented in step 67. After loading the new gain value in step 68, the routine is exited in step 73.

The portion of the software used by the microprocessor which is relevant to the method of FIG. 7 is shown in FIG. 8. The listing is from a printout generated by an MCS-51 Macro Assembler with the source program written for the Intel 8751 microprocessor and associated peripherals as described in application Ser. No. 780,548. A portion of the main program is shown which executes the 130 mS delay. After the delay, the "B_START_ENABLE" bit is set. As long as this bit is set, the interrupt service routine (not shown) will jump to the start-up current gain adjustment routine at each interrupt caused by a current zero-crossing.

Prior to the execution of the gain adjustment routine, the main program initializes "V_SF_PTR" to the gain value, and "A_I_REF" to the control reference which is about half the current command reference for 100% light level. "I_DAC" is the address of the multiplying D/A converter.

The foregoing describes a method and apparatus for adjusting the feedback gain in a fluorescent lamp dimming control to a value which normalizes current feedback with the control constants. Full load current is estimated without that level of current actually flowing to the ballasts. Thus, the dimming system operates with a wide range of load sizes without modification.

While preferred embodiments of the present invention have been shown and described herein, it will be obvious that such embodiments are provided by way of example only. Numerous variations, changes and substitutions will occur to those skilled in the art without departing from the spirit of the invention. Accordingly, it is intended that the invention be limited only by the scope of the appended claims.

What is claimed is:

1. A method for estimating full load current for a fluorescent lighting system employing a plurality of fluorescent lamps, comprising the steps of:

(1) turning on full power to said fluorescent lighting system; and (2) measuring the current flowing to said fluorescent lighting system after initial transients decay and before the lamps of said lighting system begin conducting.

2. The method of claim 1 further comprising the step of:

increasing the current measured in said measuring step by a factor of about two to obtain an estimate of full load current.

3. The method of claim 1 wherein said measuring step is performed between about 100 milliseconds and about 400 milliseconds after said turning on step.

4. A method for normalizing current feedback in a fluorescent lamp dimming control connected to a fluorescent lighting system by adjusting feedback gain of the dimming control, said method comprising the steps of:

(1) turning on full power to said fluorescent lighting system;

(2) setting said feedback gain to an initial value;

(3) measuring current flowing to said lighting system after initial transients decay and before the lamps of said lighting system begin conducting, using said feedback gain to obtain a measured current value;

(4) comparing said measured current value with a control reference value to ascertain any difference therebetween; and (5) if the ascertained difference is greater than a predetermined value, then adjusting said feedback gain in a manner which causes said measured current value to approach said control reference value.

5. The method of claim 4 further comprising the step of:

performing at least one additional iteration of steps 3–5 to further reduce the ascertained difference.

6. The method of claim 5 wherein all iterations of said measuring step are performed between about 100 milliseconds and about 400 milliseconds after said turning on step.

7. A method for adjusting feedback gain of a fluorescent lamp dimming control connected to a fluorescent lighting system, said method comprising the steps of:

(1) turning on full power to said fluorescent lighting system;

(2) setting said feedback gain to its highest permissible value;

(3) measuring current flowing to said lighting system after initial transients decay and before the lamps of said lighting system begin conducting, using said feedback gain to obtain a measured current value;

(4) subtracting a control reference value from said measured current value;

(5) if the result of said subtracting step is positive, than decreasing said feedback gain by a single predetermined step; and (6) repeating steps 3–5 until the result of said subtracting step is not positive, whereby the first feedback gain value giving a non-positive result in said subtracting step is the final value.

8. The method of claim 7 wherein said control reference value represents one-half of full load current at full lamp brightness.

9. Apparatus for providing adjustable current feedback in a microprocessor controlled fluorescent lamp dimming system comprising:

current sensing means adapted to be coupled to a fluorescent lighting system including a ballast for providing a voltage proportional to the current flowing to the ballast of said fluorescent lighting system;

adjustable scaling means coupled to said current sensing means for scaling said voltage with an adjustable gain, said adjustable scaling means being adapted to be coupled to said microprocessor for receiving the amount of said adjustable gain;

voltage-controlled oscillator means coupled to said adjustable scaling means for providing a signal having a frequency proportional to the magnitude of the output signal of said scaling means; and counter means coupled to said voltage-controlled oscillator means for counting the pulses in said signal provided by said voltage-controlled oscillator means, said counted pulses representing the integral of said output signal of said scaling means, said counter means being adapted to be coupled to said microprocessor for providing the results of said counting to said microprocessor.

10. The apparatus of claim 9 wherein said adjustable scaling means comprises a multiplying digital-to-analog converter.

11. A fluorescent lamp dimming system comprising: a microprocessor;

current sensing means adapted to be coupled a fluorescent lighting system for providing a voltage proportional to the current flowing to the ballast of said fluorescent lighting system;

adjustable scaling means coupled to said current sensing means and said microprocessor for scaling said voltage with an adjustable gain, the amount of said gain being controlled by said microprocessor;

voltage-controlled oscillator means coupled to said adjustable scaling means for providing a signal having a frequency proportional to the magnitude of the output signal of said scaling means; and counter means coupled to said voltage-controlled oscillator means and said microprocessor for counting the pulses in said signal provided by said voltage-controlled oscillator means, said counted pulses representing the integral of said output signal of said scaling means, said counter means separately counting pulses during each half-cycle of current supplied to said fluorescent lighting system.

12. The fluorescent lamp dimming system of claim 11 wherein said microprocessor contains programming for implementing the steps of:

(1) turning on full power to said fluorescent lighting system;

(2) setting said adjustable gain to its highest permissible value;

(3) measuring current flowing to said lighting system after initial transients decay and before the lamps of said lighting system begin conducting, using said adjustable gain to obtain a measured current value;

(4) subtracting a control reference value from said measured current value;

(5) if the result of said subtracting step is positive, then loading a new value for said adjustable gain in said scaling means which is decreased by a single predetermined step from the previous value; and (6) repeating steps 3–5 until the result of said subtracting step is not positive, whereby the first gain value giving a non-positive result in said subtracting step is the final value.

13. The fluorescent lamp dimming system of claim 12 wherein said control reference value is stored in said microprocessor and represents one-half of full load current at full lamp brightness.

14. The fluorescent lamp dimming system of claim 12 further comprising:

a controllable series switch for connecting in series with said fluorescent lighting system, said series switch being operable to turn on and off rapidly during a notch period within each half-cycle of current supplied to said lighting system to supply filament power to the lamps of said lighting system, and said series switch being operable to turn on during the portions of each half-cycle outside of said notch period to establish a low frequency, variable duty cycle current resulting in a controllable light output from said lamps; and timing means coupled to said microprocessor and to said series switch for controlling the timing of said notch period in response to commands from said microprocessor.

15. The fluorescent lamp dimming system of claim 14 wherein said adjustable scaling means comprises a multiplying digital-to-analog converter.

* * * * *